US005863224A

United States Patent [19]

Saba et al.

[11] Patent Number: 5,863,224

[45] **Date of Patent: *Jan. 26, 1999**

[54] RETAINER TYPE CONNECTOR

[75] Inventors: Toshikazu Saba; Masami Toyoda, both of Yokkaichi; Takafumi Kishi, Fujisawa, all of Japan

[73] Assignees: Sumitomo Wiring Systems, Ltd.; Nissan Motor Co., Ltd., both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 611,078

[22] Filed: Mar. 5, 1996

[30] Foreign Application Priority Data

Mar. 7, 1995 [JP] Japan ..... 7-077365

[51] Int. Cl.[6] ..... H01R 13/436

[52] U.S. Cl. ..... 439/752

[58] Field of Search ..... 439/752

[56] References Cited

U.S. PATENT DOCUMENTS 5,066,252 11/1991 Kato et al. ..... 439/752
5,186,662 2/1993 Yuasa et al. ..... 439/752
5,203,722 4/1993 Kinoshita ..... 439/752
5,634,826 6/1997 Jean et al. ..... 439/752

FOREIGN PATENT DOCUMENTS 0251518 1/1988 European Pat. Off. .

*Primary Examiner*—Gary F. Paumen
*Attorney, Agent, or Firm*—Jordan B. Bierman; Bierman, Muserlian and Lucas

[57] ABSTRACT

A retainer type connector can prevent a flexible locking piece from being broken and enhance properties of a housing and a retainer satisfactorily. In this retainer type connector, when retainers (43*a*) are inserted into retainer-mounting holes (41*c*) in a base body (41), lock arms (41*e*1, 41*e*2) employed as flexible locking pieces, which are provided on inner peripheral wall of the retainer-mounting holes (41*c*) to be protected from foreign substances, are readily deflected to engage with protrusions (43*b*1, 43*b*2) of the retainers (43*a*) employed as fixed locking pieces, thereby preventing the lock arms from being broken even if coupling and detaching operations are repeated. The base body (41) as a housing and the retainer can be made of a suitable resilient resin material and a suitable hard resin material, respectively.

4 Claims, 6 Drawing Sheets

RETAINER TYPE CONNECTOR

BACKGROUND OF THE INVENTION (1) Field of the Invention

This invention relates to a retainer type connector including a retainer which retains terminals in a housing and more particularly relates to a retainer type connector provided with an interlocking mechanism which interconnects the housing and the retainer.

(2) Statement of the Prior Art

Heretofore, a known retainer type connector comprises: a housing which includes a plurality of terminal-containing chambers, a plurality of retainer-mounting holes, and fixed protrusions on the inner peripheral walls in the retainer-mounting holes; and a plurality of retainers each of which is adapted to be received in each retainer-mounting hole and is provided on its outer peripheral walls with an arm-like flexible locking piece adapted to retain the terminals in the terminal-containing chambers.

When the retainer is inserted into a given position in the retainer-mounting hole, the flexible locking piece on the retainer passes over the fixed protrusion on the housing so they interlock each other, thereby preventing the retainer from coming out of the housing.

For convenience of explanation, a conventional retainer type connector will be explained below by referring to FIGS. 8 through 10. FIG. 8 is a longitudinal sectional view of a conventional retainer type connector, illustrating a state in which retainers are interlocked to a housing. FIG. 9 is a longitudinal sectional view of the retainer type connector, illustrating another state in which the retainers are interlocked to the housing. FIG. 10 is a partially enlarged view of the conventional retainer type connector, illustrating a state in which the retainer is interlocked to the housing.

In the conventional retainer type connector, as shown in FIGS. 8 and 9, a housing 1 and a retainer 2 are provided with fixed protrusions 1*a* and 2*a*, respectively. The retainer 2 is forced to be inserted into the housing 1.

In the conventional retainer type connector, there were the following problems:

The retainer is provided with a flexible locking piece (not shown) which is exposed outwardly. The piece happens to strike and hook on foreign substances during carriage and results in breakage. Although the retainer has to be hard in order to lock terminals, the flexible locking piece has to be elastical. The foregoing depends on the choice of the material. On the other hand, although the housing has to be resilient so as to make the lance resilient, the fixed locking piece has to be hard so as to receive the flexible locking piece on the retainer. This again depends on the choice of the material.

In the case of the forced engagement type structure, the fixed protrusions 1*a* and 2*a* will be broken and be in an unlocked state as shown in FIG. 10, if the attaching and detaching operations are repeated every time maintenance work is carried out.

SUMMARY OF THE INVENTION

An object of the present invention is to provide a retainer type connector in which a flexible locking piece can be prevented from being broken and properties of a housing and a retainer can be enhanced satisfactorily.

In order to achieve the above object, a retainer type connector in accordance with the present invention comprises: a housing including a plurality of terminal-containing chambers and at least one retainer-mounting hole; at least one retainer adapted to be received in the retainer-mounting hole to retain terminals in the terminal-containing chambers; and at least one interlocking mechanism for interlocking the retainer to the housing, the interlocking mechanism including at least one flexible locking piece provided in the interior of the retainer-mounting hole in the housing and at least one fixed locking piece provided on the retainer and adapted to be engaged with the flexible locking piece.

According to the retainer type connector of the present invention, the interlocking mechanism for coupling the retainer to the housing includes the flexible locking piece provided in the interior of the retainer-mounting hole in the housing so as to give the resin lance and flexible locking piece satisfactory elastic properties and the fixed locking piece a satisfactory degree of hardness. The flexible locking piece is disposed in the interior of the retainer-mounting hole not to be exposed outside.

According to the present invention, since the housing and retainer can be chosen from a range of suitable materials, respectively, it is possible to provide the retainer type connector in which the basic performance can be enhanced and the flexible locking piece, which is obliged to be comprised of very few parts, can be prevented from being broken. In the forced engagement type structure, the flexible locking piece will not be also broken either.

DETAILED DESCRIPTION OF THE PREFERRED EMBODIMENTS

Figure 1:
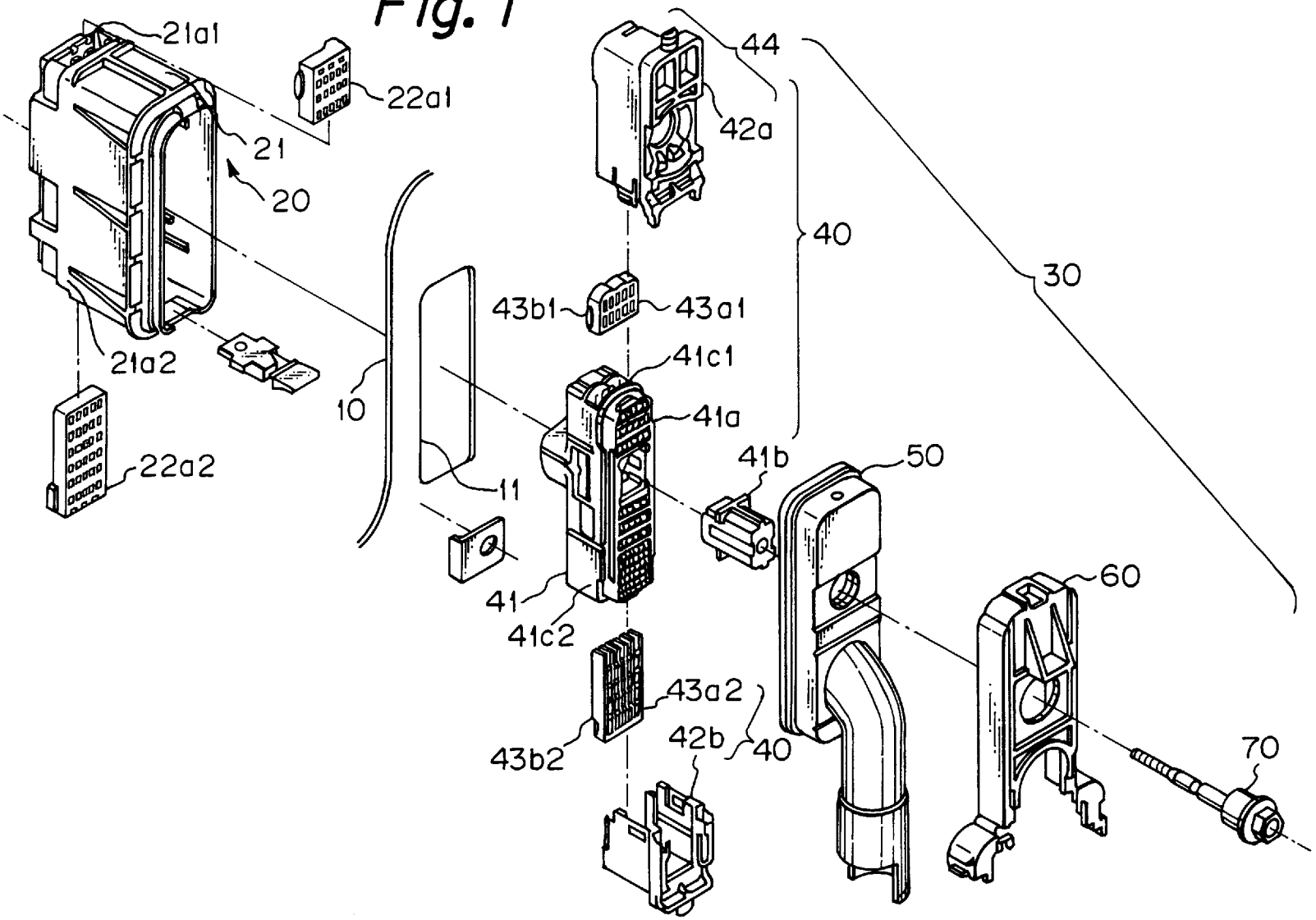
FIG. 1 is an exploded perspective view of a panel-mounted connector assembly to which an embodiment of a retainer type connector in accordance with the present invention is applied.

Referring now to the drawings an embodiment of the present invention will be described below.

Figure 2:
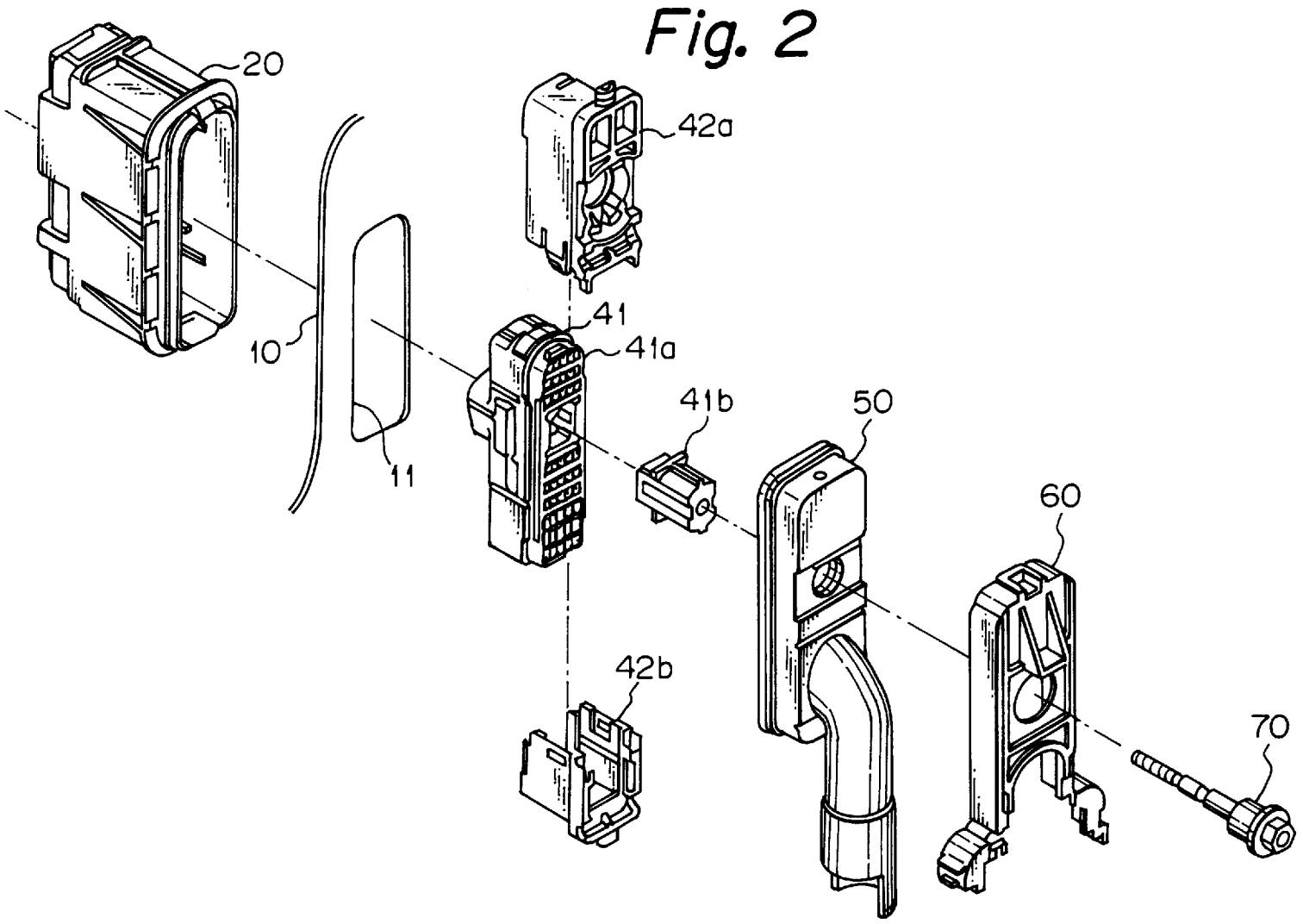
FIG. 2 is an exploded perspective view of the panel-mounted connector assembly shown in FIG. 1, illustrating how retainers are coupled to housings.

FIG. 1 shows an exploded perspective views of a panel-mounted connector assembly which utilizes an embodiment of a retainer type connector of the present invention. FIG. 2 shows the panel-mounted connector assembly shown in FIG. 1 in which a retainer is inserted in the retainer type connector. The panel-mounted connector assembly includes an inner connector 20 which is attached to the inside of a through hole 11 in a panel 10 and an outer connector 30 which is attached to the outside of the through hole 30. The outer connector 30 comprises a connector housing 40 which contains terminals, a grommet 50 which comes into contact with the panel 10 on the periphery to cover the outside of the housing 40, and a grommet cover 60 which pushes the periphery of the grommet 50 to the panel 10 to cover the outside of the grommet 50. A bolt 70 is inserted from the outside of the outer connector 30 through the hole 11 to the inner connector 20 and is screwed to the connector 20 to interconnect both connectors 20 and 30. A surface of each connector which confronts the panel 10 is hereinafter referred to a front side.

As shown in FIG. 1, the inner connector 20 includes a box-like housing 21 with a bottom wall, which is provided with a plurality of terminal-containing chambers arranged in a grid manner and passed therethrough. Male terminals are contained in the chambers. The inner connector 20 is provided on its upper and lower walls with retainer-mounting holes 21*a*1 and 21*a*2 (hereinafter referred to as retainer-mounting holes 21*a* when both holes are indicated), which extend across the terminal-containing chambers. Retainers 22*a*1 and 22*a*2 (hereinafter referred to as retainers 22*a* when both retainers are indicated) are inserted into the retainer-mounting holes 21*a*1 and 21*a*2 to carry out a double lock of terminals.

On the other hand, the housing 40 of the outer connector 30 includes a plurality of terminal-containing chambers 41*a* arranged in a grid manner and adapted to accommodate female terminals, a base body 41 having a configuration adapted to be inserted in the inner connector 20, and a cap unit 42 having upper and lower caps 42*a* and 42*b* which cover the rear side of the base body 41. The base body 41 is adapted to receive at the rear side a sleeve 41*b* which is made of a hard resin material and permits the bolt 70 to pass therethrough. The base body 41 is provided on its upper and lower walls with retainer-mounting holes 41*c*1 and 41*c*2 (hereinafter referred to as retainer-mounting holes 41*c* when both holes are indicated), which extend across the terminal-containing chambers 41*a*. Retainer 43*a*1 and 43*a*2 (hereinafter referred to retainers 43*a* when both retainers are indicated) are inserted into the retainer-mounting holes 41*c*1 and 41*c*2 to effect a double lock of terminals. The base body 41 is provided with the terminal-containing chambers 41*a* each of which has a resin lance made of a resilient resin material.

Figure 3:
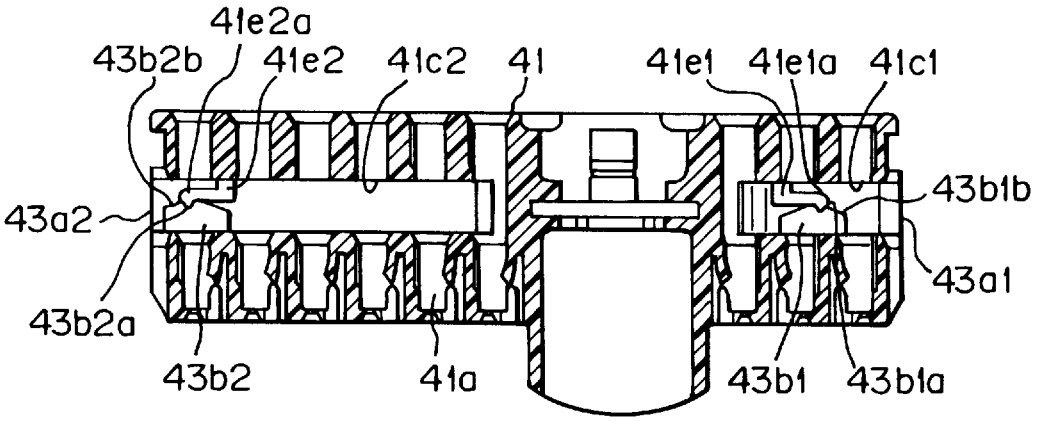
FIG. 3 is a longitudinal sectional view of the retainer type connector in which retainers are temporarily interlocked to a base body.
Figure 5:
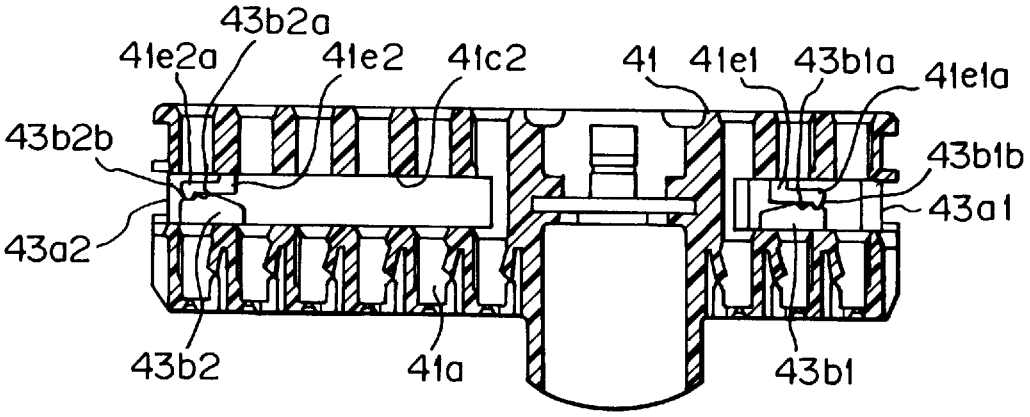
FIG. 5 is a longitudinal sectional view of the retainer type connector shown in FIG. 3 in which the retainers are regularly interlocked to the base body.

The respective retainers 22*a* and 43*a* are made of a relatively hard resin material, are formed into box-like shapes, and are provided with grid-like through holes in association with the terminal-containing chambers. A protrusion is formed in each through hole so as to lock the terminal. By way of example, in the outer connector 30, the base body 41 is provided in the retainer-mounting holes 41*c*1 and 41*c*2 with lock arms 41*e*1 and 41*e*2, as shown in FIGS. 3 and 5. The retainers 43*a*1 and 43*a*2 are provided on their opposite side walls with projections 43*b*1 and 43*b*2 which are adapted to engage with the lock arms 41*e*1 and 41*e*2, respectively. The lock arms 41*e*1 and 41*e*2 extend from the inner part towards the open port in the retainer-mounting holes 41*c*1 and 41*c*2 to display flexibility and are provided with protrusions 41*e*1*a* and 41*e*2*a* which project in a direction perpendicular to an axial direction, thereby forming the flexible locking pieces. The projections 41*e*1*a* and 41*e*2*a* are formed into wedge-like shapes. On the other hand, the projections 43*b*1 and 43*b*2 confront the wedge-like projections 41*e*1*a* and 41*e*2*a* and are provided on their upper surfaces with two sets of depressions 43*b*1*a*, 43*b*1*b* and 43*b*2*a*, 43*b*2*b*. When the retainers 43*a*1 and 43*a*2 are inserted into the retainer-mounting holes 41*c*1 and 41*c*2, respectively, the projections 41*e*1*a* and 41*e*2*a* on the flexible arms 41*e*1 and 41*e*2 enter the depressions 43*b*1*a*, 43*b*1*b* and 43*b*2*a*, 43*b*2*b* in the projections 43*b*1 and 43*b*2 in order, thereby locking the retainers 43*a*1 and 43*a*2. This structure defines the fixed locking piece.

Although the box-like retainers 22*a* and 43*a* are inserted in the retainer-mounting holes 21*a* and 41*c*1 in the housing 21 and base body 41 in this embodiment, the configurations of the retainers are not limited to the box-like shapes. The retainers may be formed into any shapes so long as the retainers have the interlocking mechanism. Also, the lock arms 41*e*1, 41*e*2 and projections 43*b*1, 43*b*2 which constitute the interlocking mechanism are not limited to the above embodiment so long as the lock arms 41*e*1, 41*e*2 and the projections 43*b*1, 43*b*2 serve as the flexible locking pieces on the housing and as the fixed locking pieces on the retainer. The flexible locking piece does not have to be the arm-like configuration but any spring member so long as the locking piece is elastical and is disposed in the retainer-mounting hole to protect it against any foreign substances. Further, the fixed locking piece on the retainer may be a little flexible so long as the piece is not broken when the piece strikes any foreign substances.

Next, an operation of the above embodiment of the present invention will be explained below by referring to the base body 41 of the outer connector 30.

Figure 4:
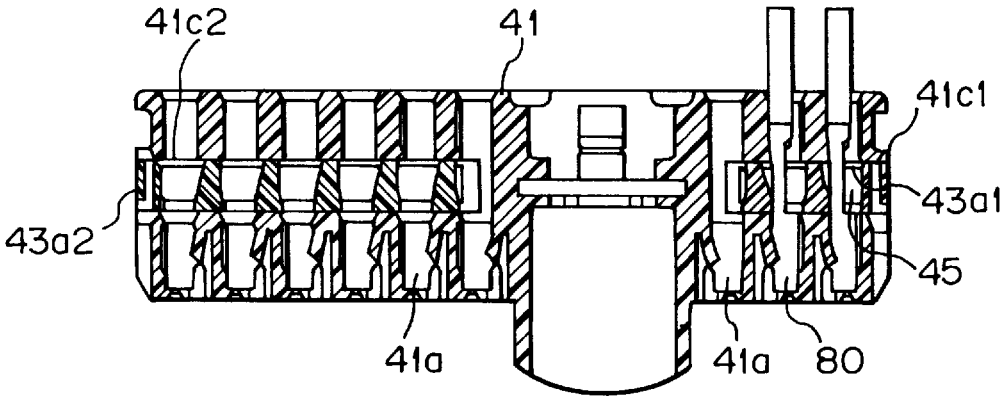
FIG. 4 is a longitudinal sectional view of the retainer type connector shown in FIG. 3 in which terminals are temporarily contained in the housing.
Figure 6:
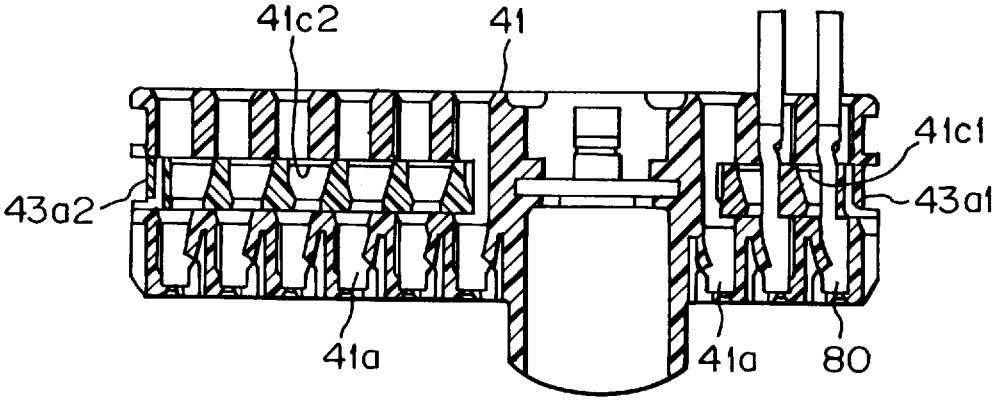
FIG. 6 is a longitudinal sectional view of the retainer type connector shown in FIG. 5 in which the terminals are regularly contained in the housing.
Figure 7:
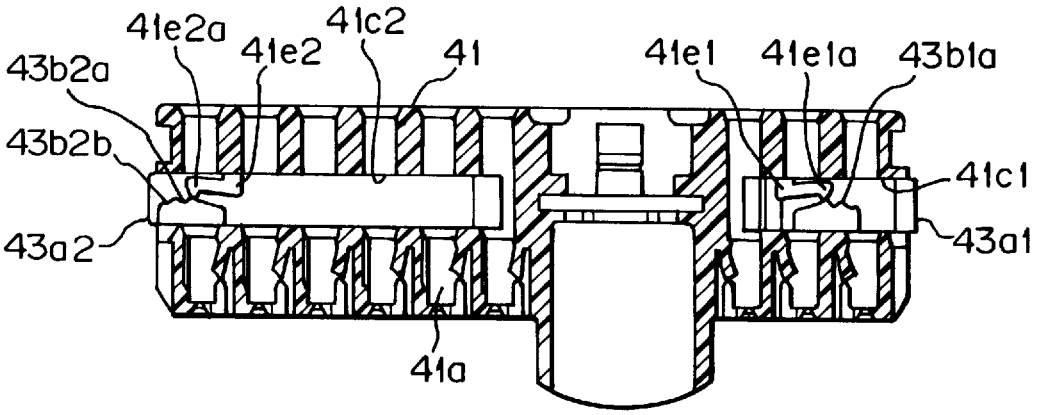
FIG. 7 is a longitudinal sectional view of the retainer type connector shown in FIG. 3 in which the retainers are interlocked to the base body.
Figure 10:
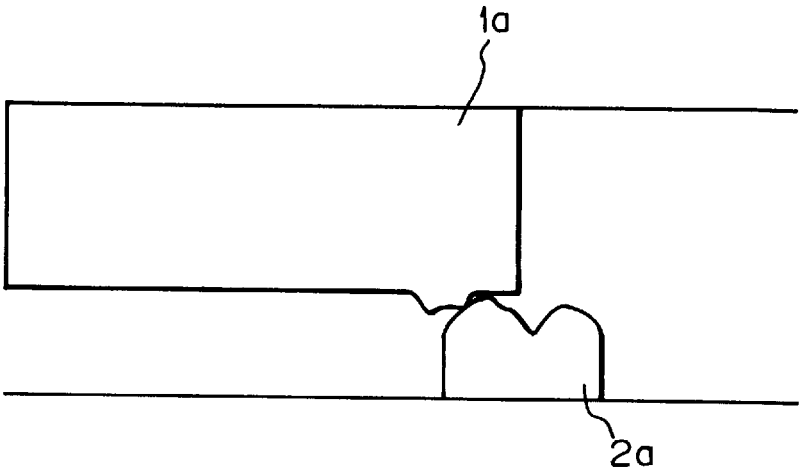
Fig. 10 PRIOR ART
FIG. 10 is a partially enlarged view of the conventional retainer type connector, illustrating a state in which the retainer is interlocked to the housing.
Figure 8:
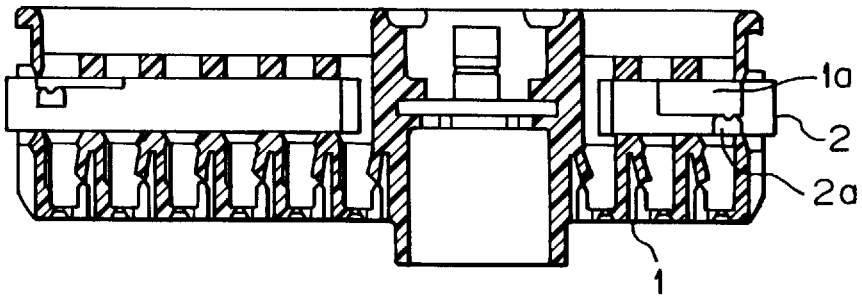
Fig. 8 PRIOR ART
FIG. 8 is a longitudinal sectional view of a conventional retainer type connector, illustrating a state in which retainers are interlocked to a housing.
Figure 9:
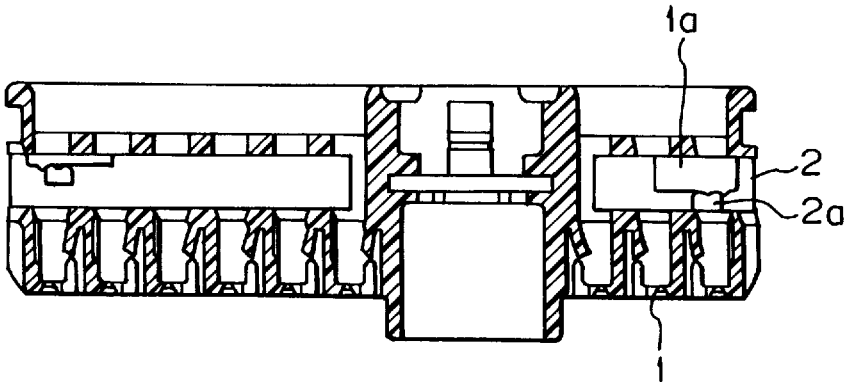
Fig. 9 PRIOR ART
FIG. 9 is a longitudinal sectional view of the retainer type connector, illustrating another state in which the retainers are interlocked to the housing.

FIGS. 3 and 5 show the sectional views of the base body 41, illustrating the two steps of engaging positions between the lock arms 41*e*1, 41*e*2 and the projections 43*b*1, 43*b*2. FIGS. 4 and 6 show the sectional views of the base body 41, illustrating the primary and secondary locking positions of the terminals in association with the engaging positions shown in FIGS. 3 and 5.

When the retainers 43*a*1 and 43*a*2 are inserted into the retainer-mounting holes 41*c*1 and 41*c*2 in the base body 41, the projections 43*b*1 and 43*b*2 are moved towards the lock arms 41*e*1 and 41*e*2. Although the projections 41*e*1*a* and 41*e*2*a* on the lock arms 41*e*1 and 41*e*2 come into contact with a distal end wall of the projections 43*b*1 and 43*b*2, the lock arms 41*e*1 and 41*e*2 are deflected down since the lock arms 41*e*1 and 41*e*2 are formed into the arm-like configurations and are made of a suitable flexible resin and then the projections 41*e*1*a* and 41*e*2*a* on the lock arms 41*e*1 and 41*e*2 ride on the projections 43*b*1 and 43*b*2. When the retainers 43*a*1 and 43*a*2 move further forward, the projections 41*e*1*a* and 41*e*2*a* enter and engage with the depressions 43*b*1*a* and 43*b*2*a* in the projections 43*b*1 and 43*b*2. This position is called a temporary position. At this time, the grid of the terminal-containing chambers 41*a* accords with those of the retainers 43*a*1 and 43*a*2, so that the female terminals crimped on electrical wires can be inserted into the chambers 41*a* from the rear side. FIG. 4 shows each female terminal 80 locked on the resin lance 45 on the base body 41.

After all terminals are inserted in the terminal-containing chambers 41*a*, the retainers 43*a*1 and 43*a*2 are further pushed into the retainer-mounting holes 41*c*1 and 41*c*2. Then, the projections 41*e*1*a* and 41*e*2*a* on the lock arms

41*e*1 and 41*e*2 ride over the hills between the depressions 43*b*1*a* and 43*b*1*b* and between the depressions 43*b*2*a* and 43*b*2*b* and enter and engage with the inner depressions 43*b*1*b* and 43*b*2*b*. This position is called as a regular locking position. Since the lock arms 41*e*1 and 41*e*2 are easily deflected down when the wedge-shaped projections 41*e*1*a* and 41*e*2*a* ride over the hills, the projections 41*e*1*a*, 41*e*2*a* and projections 43*b*1, 43*b*2 will not be broken or sharpened.

Thus, when the retainers 43*a*1 and 43*a*2 are pushed, the protrusions on the grid-like through holes engage with the female terminals 80, thereby bringing the terminals into the double lock state, as shown in FIG. 6. Since the retainers 43*a*1 and 43*a*2 are made of a relatively hard resin material, it is possible to make the protrusions, which engage with the female terminals 80, hard, thereby ensuring a firm hold with the female terminals.

On the other hand, in the case of drawing the retainers 43*a*1 and 43*a*2 out of the retainer-mounting holes 41*c*1 and 41*c*2, the projections 41*e*1*a* and 41*e*2*a* on the lock arms 41*e*1 and 41*e*2 come into contact with the projections 43*b*1 and 43*b*2 and are deflected down due to their flexibility, so that the retainers 43*a*1 and 43*a*2 can be readily drawn out without breaking the hills of the projections.

Although the base body 41 of the outer connector 30 is explained above by way of example, the same explanation will be applied to the inner connector 20. Since the lock arms 41*e*1 and 41*e*2 are formed in the interiors of the retainer-mounting holes 41*c*1 and 41*c*2, the lock arms 41*e*1 and 41*e*2 are not exposed even if the retainers 22*a* and 43*a* are not inserted in the holes 41*c*1 and 41*c*2 and will not be broken even if any foreign substances strike the base body 41.

Thus, the lock arms 41*e*1 and 41*e*2, as the flexible locking pieces, are easily deflected when the retainers 43*a* are inserted into the retainer-mounting holes 41*c* and engage with the projections 43*b*1 and 43*b*2 on the retainers 43*a* as the fixed locking pieces. Consequently, the lock arms will not be broken by repeated attachment and detachment of the retainers. It is also possible to make the base body 41 as the housing and the retainer 43*a* from the elastic resin material and the hard resin material.

What is claimed is:

1. A retainer connector comprising a housing including a plurality of housing chambers adapted to receive terminals, at least one retainer-mounting hole, and at least one retainer having retainer chambers, said retainer adapted to be inserted into said hole in an insertion direction perpendicular to a terminal insertion direction, thereby to retain said terminals in said housing chambers, at least one mechanism for interlocking said retainer and said housing, said mechanism including at least one flexible lock piece located in said hole in said housing but outside said housing chambers, and at least one fixed lock piece located on said retainer, said retainer having a temporary position, wherein said retainer chambers are in axial alignment with said housing chambers, and a regular position, wherein said retainer chambers are partially out of axial alignment with said housing chambers, thereby locking said terminals in said housing.

2. The retainer connector of claim 1 wherein said fixed lock piece comprises, in order in said retainer insertion direction, an upwardly slanting ramp, a first depression, and a second depression whereby, when said retainer moves into said housing, said flexible piece rides up said ramp and, when said retainer reaches said temporary position, said flexible piece is in said first depression and, when said retainer moves from said temporary position to said regular position, said flexible lock piece enters said second depression.

3. The retainer connector of claim 1 wherein wherein said retainer is made of a harder material than said housing.

4. The retainer connector of claim 1 wherein there are two retainers and two retainer-mounting holes.

* * * * *